US007311438B2

(12) United States Patent
Kim et al.

(10) Patent No.: US 7,311,438 B2
(45) Date of Patent: Dec. 25, 2007

(54) AGITATOR, IMAGE FORMING APPARATUS HAVING THE SAME AND METHOD FOR AGITATING

(75) Inventors: Myoung-Chan Kim, Seoul (KR); Gwoang-Joe Seorl, Suwon-si (KR); Sung-Dae Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 214 days.

(21) Appl. No.: 11/024,710

(22) Filed: Dec. 30, 2004

(65) Prior Publication Data

US 2005/0238389 A1 Oct. 27, 2005

(30) Foreign Application Priority Data

Apr. 22, 2004 (KR) ..... 10-2004-0027973

(51) Int. Cl.
*B01F 7/02* (2006.01)
*B01F 7/08* (2006.01)

(52) U.S. Cl. ..... 366/295; 366/329.1; 366/320; 399/256

(58) Field of Classification Search ..... 366/320, 366/310, 280, 293, 292, 295, 294, 296, 82, 366/81, 329.1; 399/263, 256
See application file for complete search history.

(56) References Cited

U.S. PATENT DOCUMENTS 2,784,951 A * 3/1957 Bakewell ..... 366/296
3,047,034 A * 7/1962 Sassmannshausen et al. ..... 141/311 R
3,148,802 A * 9/1964 Webb ..... 222/643
3,186,602 A * 6/1965 Ricciardi ..... 222/161
3,508,687 A * 4/1970 Burgstaller ..... 222/162
4,154,372 A * 5/1979 Ricciardi ..... 222/238
4,509,860 A * 4/1985 Lasar, III ..... 366/99
4,739,907 A * 4/1988 Gallant ..... 222/240
4,900,158 A * 2/1990 Ugolini ..... 366/143
5,213,415 A * 5/1993 Saeki ..... 366/294
6,752,530 B2 * 6/2004 Pecis ..... 366/295

FOREIGN PATENT DOCUMENTS

| | | |
|---|---|---|
| JP | 05-066665 | 3/1993 |
| JP | 6-10953 | 2/1994 |
| JP | 08-137225 | 5/1996 |
| JP | 11-202607 | 7/1999 |
| KR | 1993-020220 | 9/1993 |
| KR | 1998-012902 | 6/1998 |

* cited by examiner

*Primary Examiner*—Tony G. Soohoo
(74) *Attorney, Agent, or Firm*—Roylance, Abrams, Berdo & Goodman, L.L.P.

(57) ABSTRACT

An agitator according to the present invention comprises a container for storing a compound of at least two materials, and an agitation unit mounted in the container to agitate the compound. The agitation unit may comprise a plurality of agitators of which at least one agitator can independently rotate.

21 Claims, 6 Drawing Sheets

AGITATOR, IMAGE FORMING APPARATUS HAVING THE SAME AND METHOD FOR AGITATING

CROSS-REFERENCE TO RELATED APPLICATIONS

This application claims the benefit under 35 U.S.C. § 119(a) of Korean Patent Application No. 2004-0027973, filed Apr. 22, 2004, in the Korean Intellectual Property Office, the entire disclosure of which is incorporated herein by reference.

BACKGROUND OF THE INVENTION

1. Field of the Invention

The present invention relates to an agitator, an image forming apparatus having the same, and a method for agitating compounds.

2. Description of the Related Art

Generally, image forming apparatuses such as laser printers, copy machines and multi-function apparatuses are divided into two groups: a dry-type image forming apparatus and a wet-type image forming apparatus. The dry-type image forming apparatus uses a powdery toner as a developer. The wet-type image forming apparatus uses a liquid carrier, such as norpar, mixed with the toner. In both types of image forming apparatuses, the toner is supplied to an image carrier, such as a photoconductive drum, where an electrostatic latent image is formed, thereby developing an image. The developed image is printed onto a printing medium passed through a transfer medium rotating in contact with the photoconductive drum. Presently, the wet-type developing method is widely used.

A general wet-type image forming apparatus supplies a liquid developer of a certain density to a developing device and develops an electrostatic latent image formed on the image carrier such as the photoconductive drum.

The developing device may comprise, for example, a developer reservoir mounted in the vicinity of the image carrier, a developing roller mounted in the developer reservoir to transfer the developer to the image carrier, a manifold for jetting and transferring the developer to the developing roller, and a squeeze roller for removing excessive developer of the developing roller to restrict thickness of the developer.

The developer supplied to the manifold is mixed with enough toner to maintain a predetermined density. For this, a dedicated working solution tank is provided to control the developer density by mixing the liquid carrier and the powder toner by a predetermined mixture ratio. However, the dedicated working solution tank complicates the whole structure.

Therefore, a new method has been developed, in which the toner and the carrier are mixed at a predetermined density during the manufacturing process and is supplied mixed and stored in a developer cartridge. This method does not necessitate a dedicated density controller. The user only needs to replace the developer cartridge, which is more convenient.

However, in such a pre-mixed developer, the powdery toner may precipitate and clot if the image forming apparatus is left unused for a long time. Accordingly, an agitator is required to agitate the developer.

When the carrier and the toner are evenly mixed, the agitator can be driven with minor driving force, however, when the developer has precipitated and clotted for a long time, a greater amount of driving force is required for agitating the toner sludge.

Accordingly, there is a need for an agitator that requires a minimal driving force for agitating a toner sludge or developer using a single driving source.

SUMMARY OF THE INVENTION

An aspect of the present invention is to solve at least the above and other problems and to provide at least the advantages described below among others. Accordingly, an aspect of the present invention is to provide an improved agitator, which requires minimal driving force for agitating a compound such as a developer.

Another aspect of the present invention is to provide an improved image forming apparatus for agitating a developer using a single driving source.

Yet another aspect of the present invention is to provide a method for agitating a compound of at least two materials with minimal driving force.

In order to achieve an aspect of the present invention, there is provided an agitator comprising a container for storing a compound of at least two materials; and an agitation unit mounted in the container to agitate the compound. The agitation unit preferably comprises a plurality of agitators of which at least one agitator can independently rotate.

The agitation unit preferably comprises a first agitator rotatably mounted in the container to be driven by a driving source and a second agitator connected to the first agitator, which is passively driven by the first agitator. The first agitator preferably has a larger rotational radius than the second agitator.

The first agitator comprises a main axis rotatably supported by the container to be rotated by the driving source. The first agitator preferably further comprises an agitation member rotated in connection with the main axis to agitate the compound in the container.

Preferably, the agitation member is a spring spirally extended with respect to a rotation center thereof.

The main axis is provided in two like sections, and each section of the main axis is rotatably mounted on opposite sidewalls in the container.

The second agitator comprises a sub axis supported by the main axis to be selectively and passively rotated along the main axis. The second agitator preferably has a rib spirally formed on an outer circumference of the sub axis.

The rib has a smaller rotational radius than the agitation member and does not contact the agitation member.

The agitation unit preferably further comprises a power transmission unit to selectively transmit a driving force of the first agitator to the second agitator such that the second agitator is preferably passively driven.

The power transmission unit is preferably mounted in at least one of the first and the second agitators and comprises a friction member for supplying friction between the first and the second agitators. The friction member may preferably be made of rubber or may be a metal spring. Other materials or devices may be used as a friction member so long as enough friction is generated to perform the function of the friction member.

The power transmission unit preferably comprises a torque limiter between the first and the second agitators. The driving force transmitted from the first agitator to the second agitator by the power transmission unit is inversely proportional to a rotational load by the compound, which is applied to the second agitator.

The agitation unit further comprises a power transmission unit mounted between the main axis and the sub axis to selectively transmit the driving force of the main axis to the sub axis. The plurality of agitators are applied by rotational loads of different grades. The first agitator has a smaller contacting area with the compound than the second agitator. The compound includes a developer where a powdery toner and a liquid carrier are mixed at a certain predetermined mixture ratio.

The agitation unit can also comprise a first and second agitator as well as a carrier. The first agitator agitates the toner precipitated in the container. The second agitator agitates the toner, which was previously agitated by the first agitator, in addition to the carrier. The compound preferably comprises a solid and a liquid having different specific gravities from each other.

The agitation unit preferably comprises a first agitator for surfacing the solid precipitated in the liquid and a second agitator for mixing the solid surfaced by the first agitator with the liquid.

In order to achieve another aspect of the present invention, there is provided an image forming apparatus comprising a container, an agitation unit, a plurality of agitators, and a driving source. The container stores a developer which will be supplied to a developing unit. The agitation unit mounted in the container agitates the developer stored in the container. The plurality of agitators of which at least one agitator can independently rotate. The driving source supplies a driving force to rotate the agitation unit.

In another embodiment, the agitation unit preferably comprises a first agitator that directly transmits the rotating driving force from the driving source and a second agitator connected to the first agitator that is passively driven.

The agitation unit preferably further comprises a power transmission unit for selectively transmitting the driving force of the first agitator to the second agitator.

The second agitator is driven preferably when a rotational load applied to the second agitator is at a predetermined load value.

In order to achieve yet another aspect of the present invention, there is provided a method for agitating a compound of at least two materials stored in a container. The method comprises an agitator-providing step providing in the container a plurality of agitators having different rotational loads and a first rotation step rotating at least one of the plurality of the agitators.

The method further comprises a second rotation step of rotating another agitator of the plurality of agitators. The first and the second rotation steps are not performed chronologically. The first and the second rotation steps are performed in reverse order of the rotational loads applied to the agitators of each step.

The second rotation step rotates the plurality of agitators simultaneously. The second rotation step is performed by a driving force generated in the first rotation step. The agitator-providing step comprises the steps of providing a first agitator driven by a driving source and providing a second agitator with a greater rotational load applied than the first agitator. The first rotation step preferably rotates the first agitator. The method further comprises the second rotation step of rotating the second agitator. The second rotation step comprises a step of slaving the second agitator to the first agitator. The slaving step is performed when the rotational load of the second agitator is smaller than the driving force transmitted from the first agitator to the second agitator.

In yet another method for agitating a compound of at least two materials, stored in a container, the method comprises a first agitation step for operating in an initial state where the toner is cohesive; and a second agitation step for operating in a state where the cohesion of the toner is weakened by the first agitation step.

The method further comprises the steps of rotatably providing a first agitator in the container; and providing a second agitator applied by a rotational load different from that of the first agitator, wherein the first agitation step comprises a step of rotating the first agitator. The second agitation step rotates the second agitator with the first agitator simultaneously.

BRIEF DESCRIPTION OF THE DRAWING FIGURES

The above aspect and other features of the present invention will become more apparent by describing in detail exemplary embodiments thereof with reference to the attached drawing figures, wherein;

FIG. 1 schematically illustrates the structure of an image forming apparatus according to an embodiment of the present invention;

DETAILED DESCRIPTION OF THE EXEMPLARY EMBODIMENTS

Figure 1:
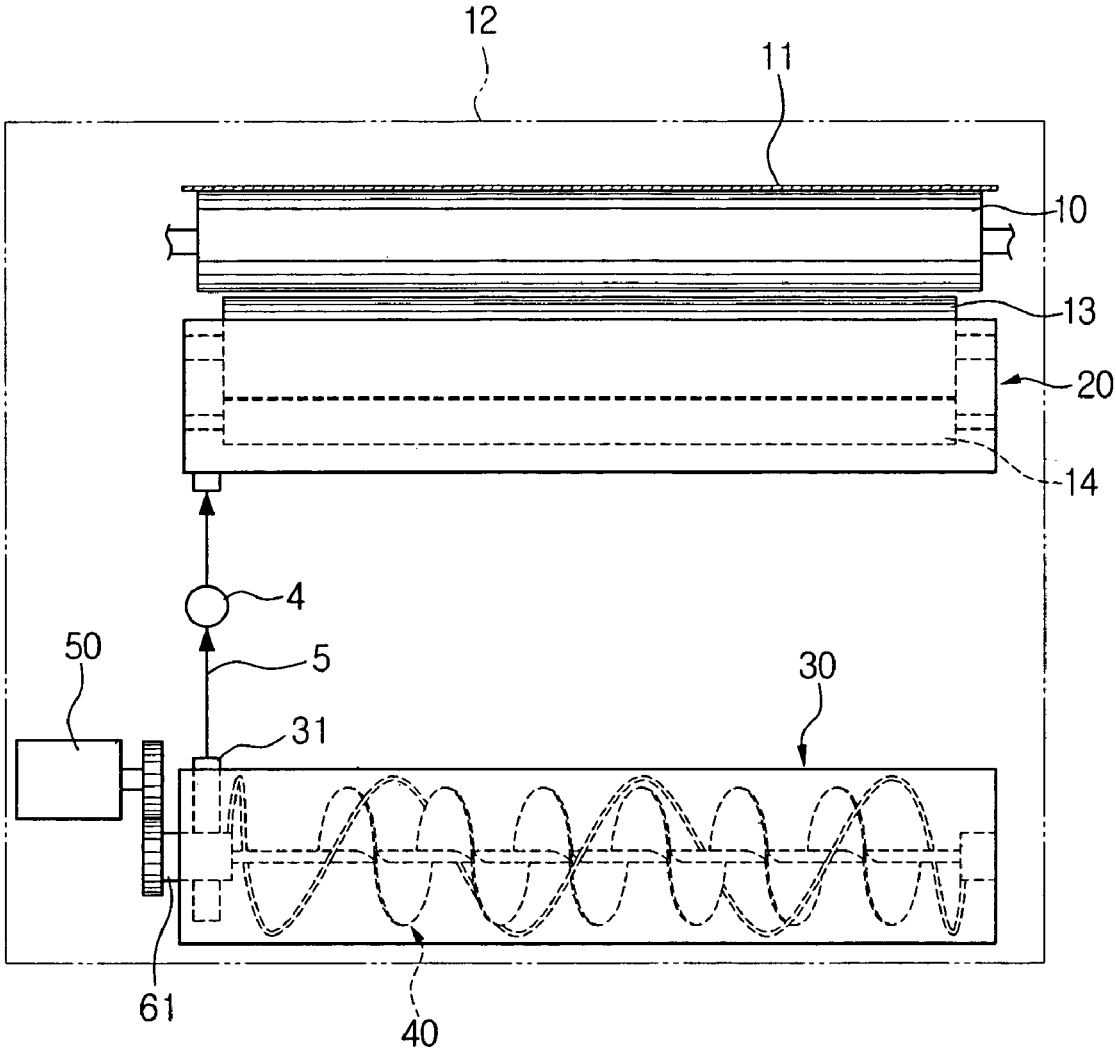

Hereinafter, an embodiment of the present invention will be described in detail with reference to the accompanying drawing figures.

In the following description, the same drawing reference numerals are used for the same elements even in different drawings. The matters defined in the description such as a detailed construction and elements are provided to assist in a comprehensive understanding of the invention. Thus, it is apparent that the present invention can be carried out without those defined matters. Also, well-known functions or constructions are not described in detail for the sake of clarity.

Referring to FIG. 1, an image forming apparatus according to an embodiment of the present invention comprises a developing unit 20 for developing an image on an image carrier 10, a container 30 for storing a predetermined compound which will be supplied to the developing unit 20, an agitator unit 40 for agitating the compound in the container 30, and a driving source 50.

The image carrier 10 for general color laser printers, copy machines and multi-function apparatuses may be a photoconductive belt or a photoconductive drum. In this embodiment, the photoconductive drum is adopted for the image carrier 10. Hereinbelow, reference number 10 will denote the photoconductive drum. A transfer medium, such as a transfer belt 11, for transferring the image formed on the photoconductive drum 10 is mounted to be in contact with the photoconductive drum 10. The structure of the photoconductive drum 10 and the transfer belt 11 will not be described in detail since it is generally well known.

The developing unit 20 forms an image on an electrostatic latent image area formed on the photoconductive drum 10. The developing unit 20 comprises a developer reservoir 21, a developing roller 23, and a squeeze roller 25. The developer reservoir 21 stores a predetermined compound supplied from the container 30.

Figure 2:
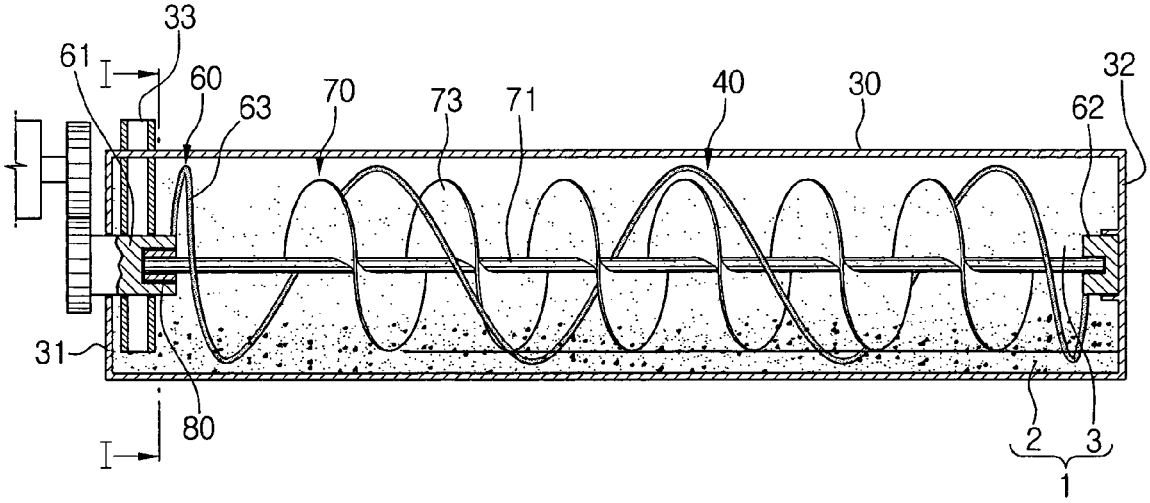
FIG. 2 is a sectional view of an agitator of FIG. 1 according to an embodiment of the present invention.

In this embodiment, as shown in FIG. 2, the compound is a developer 1 for wet-type image formation, which includes a powdery toner 2 of a certain color and a liquid carrier 3 as mixed together at predetermined mixture ratio. The developer 1 is supplied from the container 30 through a supply path 5 comprising a supply pump 4. Usually, the toner and the carrier are mixed in the developer 1 to have a density of approximately 6 to 18%.

The developing roller 23 rotates to move the developer 1 supplied to the developer reservoir 21 to the photoconductive drum 10. The developing roller 23 and the photoconductive drum 10 rotate in the same direction with a predetermined developing gap therebetween. The squeeze roller 25 squeezes out excessive developer to control the thickness of the developer 1 which will be moved to the developing roller 23. The developer reservoir 21 may further comprise a developer cleaning member (not shown) and a developer supplying roller (not shown). The general structure of the developing unit 20 will not be described for the sake of conciseness.

The container 30 is mounted in a main body 12 of the image forming apparatus together with the photoconductive drum 10 and the developing unit 20. The developer 1 to be supplied to the developing unit 20 is stored in the container 30. The container 30 is detachably mounted to the main body 12 for easy replacement after the developer is exhausted. That is, the container 30 is a replaceable ink cartridge, which is a kind of consumable. Of course, a dedicated refill-cartridge can be used to supply the developer to the container 30. The present invention does not limit the kind of the container 30 to either a consumable cartridge or the refillable cartridge.

The developer 1 stored in the container 30 is a compound comprising a toner 2 and a carrier 3, as previously explained. Other various chemicals may be added to help with image formation. Since the toner 2 has a greater specific gravity than the carrier 3, if the developer 1 is left alone, for a long period of time, the toner 2 precipitates and clots with the carrier 3. Such clotted toner 2 will be called 'toner sludge' hereinbelow. FIG. 2 illustrates a state of the toner sludge being generated.

An agitator unit 40 is mounted in the container 30 to agitate the toner sludge and the carrier 3. The agitator unit 40 comprises a first agitator 60 and a second agitator 70.

The first agitator 60, which rotates independently of the second agitator 70, primarily agitates the toner sludge precipitated on a bottom of the container 30. The first agitator 60 comprises a pair of main axes 61 and 62 mounted on opposite sidewalls 31 and 32 of the container, and an agitation member 63 attached to the main axes 61 and 62.

The first main axis 61, which is mounted on the one sidewall 31 of the container 30, transmits the driving force from the driving source 50. The second main axis 62 is rotatably supported on the other sidewall 32 of the container 30 to face the first main axis 61.

The agitation member 63 is rotated in connection with the main axes 61 and 62 to agitate the compound, which is the developer 1. The agitation member 63 is formed to have a small area contacting with the developer 1 to easily break cohesion of the toner sludge. Therefore, the agitation member 63 is preferably made by a spiral spring with its ends attached to the main axes 61 and 62. By using a thin wire spring for the agitation member 63, the friction surface with the developer 1 is minimized, and the rotational load also decreases. Therefore, the agitation member 63 can be driven by the driving source 50, which has a small output, and the toner sludge is effectively agitated. Preferably, the agitation member 63 radially extends from the rotation center of the main axes 61 and 62 to be as close as possible to an inner wall of the container 30.

The spiral spring is advantageous because it elastically transforms when the precipitated toner sludge creates a large frictional load. Therefore, the toner sludge which has been clotted for a long time can be agitated by repetitive rotation and transformation of the spiral spring.

The second agitator 70, being mounted in the container 30, operates in association with the movement of the first agitator 60. The second agitator 70 is applied with a larger rotational load than the first agitator 60 and further mixes the carrier 3 with the toner 2, which has been primarily agitated by the first agitator 60. The second agitator 70 is coaxially mounted with the first agitator 60 to passively rotate according to the rotation of the first agitator 60. Although the second agitator 70 has a smaller operational radius than the first agitator 60, the rotational load and the contacting area with the developer 1 of the second agitator 70 are larger than those of the first agitator 60.

Figure 3A:
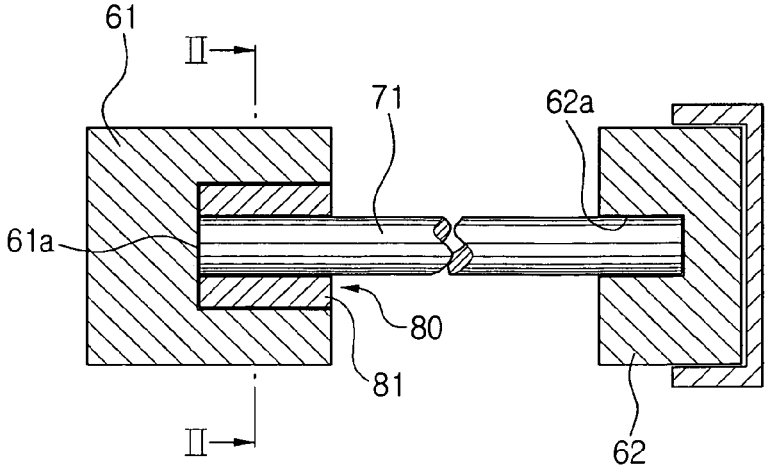
FIG. 3A is a partially enlarged sectional view of main parts of FIG. 2 according to an embodiment of the present invention.

The second agitator 70 preferably comprises a sub axis 71 rotatably supported by the main axes 61 and 62, and a spiral rib 73 attached on an outer circumference of the sub axis 71. The sub axis 71 is coaxially mounted with the main axes 61 and 62, and selectively transmits the driving force of the first agitator 60. As shown in FIG. 3A, the main axes 61 and 62 respectively have axis recesses 61*a* and 62*a* for supporting ends of the sub axis 71. The axis recesses 61*a* and 62*a* are preferably aligned with the rotation center, but may deviate from the rotation center of the first agitator 60.

The spiral rib 73 may be integrally formed with the sub axis 71. The spiral rib 73 has a larger contacting area with the developer 1 than the agitation member 63, and therefore has a larger rotational load than the agitation member 63. The spiral rib 73 may be made of metal, plastic, or any other material not easily transformed by the load. Further, the spiral rib 73 which has a smaller rotational radius than the agitation member 63, is not in contact with the agitation member 63.

Referring back to FIG. 2, a developer outlet 33 of the container 30 is usually formed at one side of the container 30, the second agitator 70 also functions to move the developer 1 toward the developer outlet 31 during rotation. For this, the spiral rib 73 is shaped as an auger, or may be configured to move the developer 1 in a certain direction regardless of a rotation direction of the sub axis 71.

Since the above-structured second agitator 70 is applied with a larger rotational load than the first structure 60, the second structure 70 needs greater initial driving force. Accordingly, the driving force is not transmitted to the sub axis 71 of the second agitator 70 until the rotational load applied to the second agitator 70 decreases to a predetermined degree. Therefore, a power transmission unit 80 is provided between the main axis 61 and the sub axis 71 to selectively transmit the driving force to the sub axis 71.

As shown in FIG. 3A, the power transmission unit 80, a friction member 81 can be mounted between the main axis 61 and the sub axis 71, for example. The friction member 81 supplies a predetermined amount of friction between the inner wall of the axis recess 61*a* and the outer circumference of the sub axis 71. The friction member 81, may be formed of urethane, rubber or any other suitable materials, which have a significant friction coefficient. According to the above structure, the driving force of the main axis 61 can be transmitted to the sub axis 71 by the friction generated by the friction member 81. The driving force transmitted from the first agitator 60 to the second agitator 70 has static friction and kinetic friction. For instance, before agitating the toner sludge, the rotational load applied to the second agitator 70 due to the toner sludge is greater than the frictional force by the friction member 81. Therefore, the second agitator 70 cannot rotate due to the rotational load. After the toner sludge is agitated, the rotational load transmitted to the second agitator 70 decreases. Therefore, the kinetic friction overcomes the rotational load, and accordingly, the driving force can be smoothly transmitted from the first agitator 60 to the second agitator 70, thereby enabling the second agitator 70 to rotate. The friction member 81 can be mounted at any side of the first agitator 60 and the second agitator 70.

Thus, the second agitator 70 can be rotated against a predetermined rotational load.

Figure 3B:
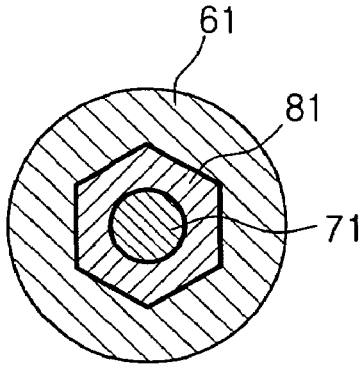
FIG. 3B is a sectional view of FIG. 3A cut along a line II-II.

In addition, as shown in FIG. 3B, a section of the friction member 81 may have a non-circular outer circumference with a circular inner circumference. In this case, the axis recess 61*a* may also have a non-circular section, and the sub axis 71 may have a circular section such that the friction member 81 can supply the frictional force to the sub axis 71 while being supported by the axis recess 61*a*. On the other side, the axis 62 and the axis recess 62*a* support the subaxis 71.

A single driving source 50 is provided to supply the driving force for the agitating unit 40. The driving source 50, which is connected to the first main axis 61 of the first agitator 60, can be a motor that outputs a predetermined rotation torque to supply the driving force.

A method for agitating a compound using the agitator according to an embodiment of the present invention will now be described.

By way of example, the compound is assumed to be the developer 1, which is a mixture of the powdery toner 2 and the carrier 3, each having different specific gravities, the mixture having a certain ratio.

If the compound is the developer 1 in the container 30, and the container 30 is an ink cartridge, the container 30 may be left unused for a long time regardless of whether it is mounted in the main body 12 or just in stock before mounting.

Due to the gravity difference between the toner 2 and the carrier 3, the toner 2 precipitates or clots, thereby generating the toner sludge. To agitate the toner sludge, a greater rotational force is required compared to when the developer 1 is well mixed.

Figure 4:
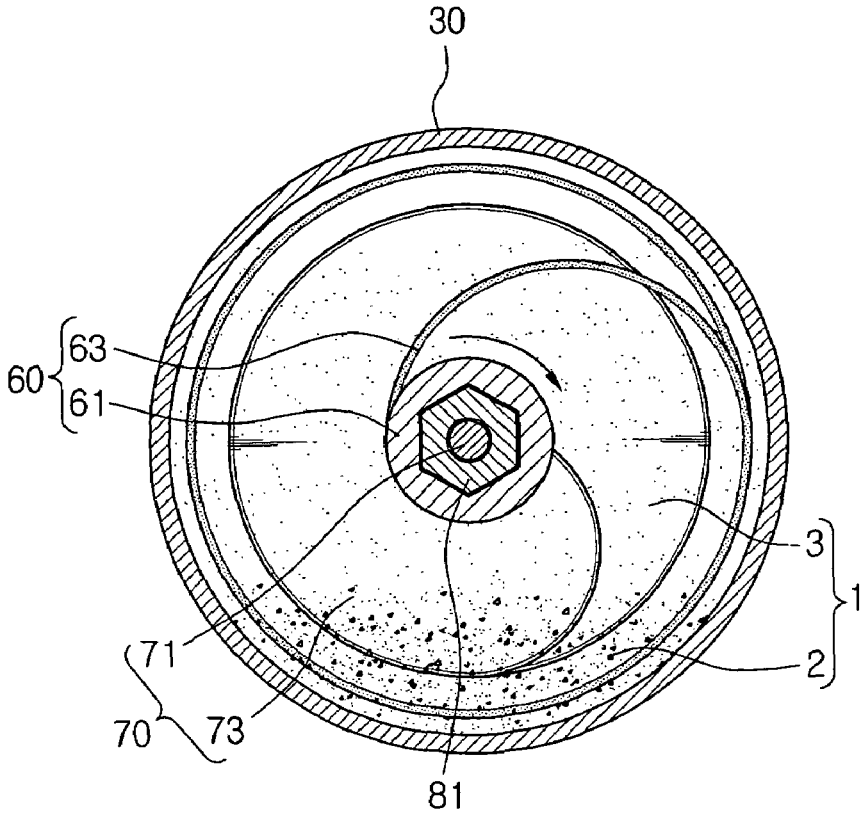
FIG. 4 is a sectional view of FIG. 2 cut along a line I-I.

First, the cohesion of the toner sludge needs to be broken using the first agitator 60. As the driving source 50 is driven, the first agitator 60 rotates ahead of the second agitator 70 since the first agitator 60 is directly connected to the driving source 50 and has a smaller rotational load than the second agitator 70. As shown in FIG. 4, the toner sludge is dissolved and surfaced by the spiral spring of the agitation member 63, and the surfaced toner 2 is mixed with the carrier 3.

At the beginning of the driving, the second agitator 70 does not rotate yet since the friction between the main axis 61 and the sub axis 71 by the friction member 81 is smaller than the rotational load applied to the second agitator 70.

Figure 5:
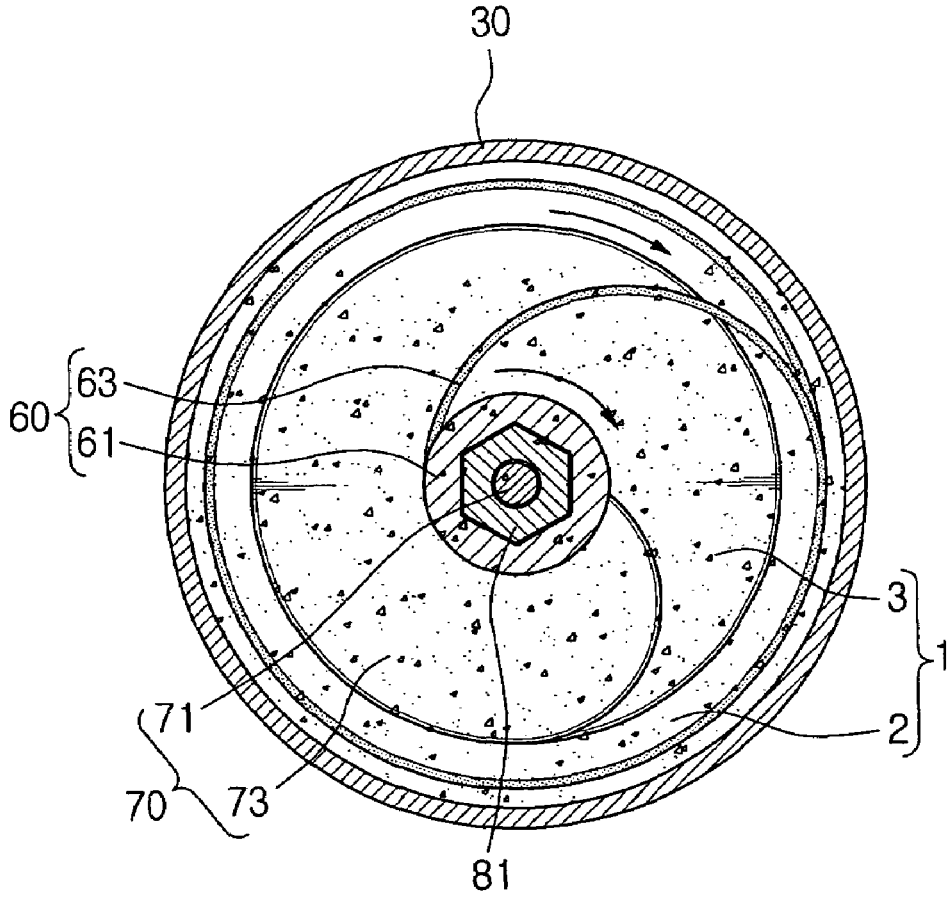
FIG. 5 is a sectional view showing a compound being more agitated than in FIG. 4.

After the first agitator 60 rotates a certain number of times, the toner sludge is agitated to some extent, and therefore, the rotational load to the second agitator 70 decreases. Then, as shown in FIG. 5, the driving force of the first agitator 60 is transmitted to the second agitator 70 by the friction member 81, and accordingly, the second agitator 70 slowly starts to rotate. While the driving source 50 is in operation, rotation speed of the second agitator 70 is lower than that of the first agitator 60. More specifically, since the second agitator 70 is driven depending upon the first agitator 60, the first agitator 60 has greater rotation speed and a greater number of rotations than the second agitator 70.

As the second agitator 70 rotates more and more, the developer 1 becomes more evenly mixed, and the rotational load applied to the second agitator 70 continues to gradually decrease. Therefore, the torque transmitted to the second agitator 70 increases, and at last, the rotation speed of the second agitator 70 equals the rotation speed of the first agitator 60. Thereby, the developer 1 is more effectively agitated. Actually, the second agitator 70 has a larger contacting area with the developer 1 than the first agitator 60. Therefore, when the second agitator 70 functions as the main agitator, the agitating performance can be improved.

As described above, the driving force transmitted from the first agitator 60 to the second agitator 70 is in inverse proportion to the rotational load applied to the second agitator 70. In addition, the first and the second agitators 60 and 70, respectively, start rotating independently and are not rotated in sequential order, however, the order of rotation is inversely proportional to the rotational loads applied to the first and the second agitators 60 and 70, respectively. While the first agitator 60 rotates at a constant speed, the second agitator 70 is rotated together with the first agitator 60 simultaneously when a predetermined rotational load is applied.

As described above, by agitating the developer 1 using at least two agitators 60 and 70, even with the driving source 50 having a minor output, the clotted toner sludge can be efficiently agitated. In other words, since the driving motor does not have to be big and expensive to obtain a large output, the present invention is cost-effective.

Figure 6:
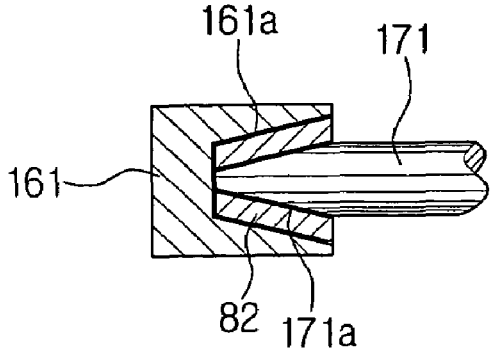
FIG. 6 is a sectional view for explaining a second embodiment of a power transmitting unit shown in FIG. 3A.
Figure 7:
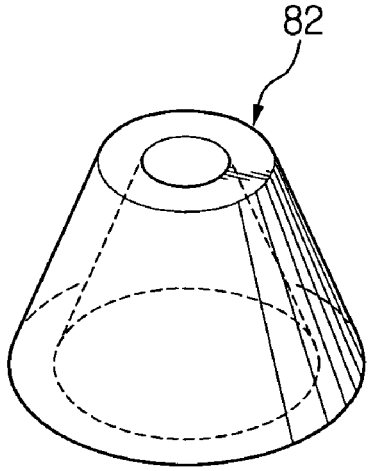
FIG. 7 is a perspective view of a friction member of FIG. 6.

Referring to FIG. 6, a friction member 82 disposed between an end 171*a* of a sub axis 171 and the main axis 161 can be applied as a second embodiment for the power transmission unit 80. An axis recess 161*a* having a dome shape or a conical shape is formed at an end of any one axis 161, and another end 171*a* of the sub axis 171 is shaped to correspond to the axis recess 161*a*. In this case, as shown in FIG. 7, the friction member 82 also may be formed from urethane, rubber or any other similar material, however, the friction member 82 has a truncated cone shape unlike the friction member 81.

Figure 8:
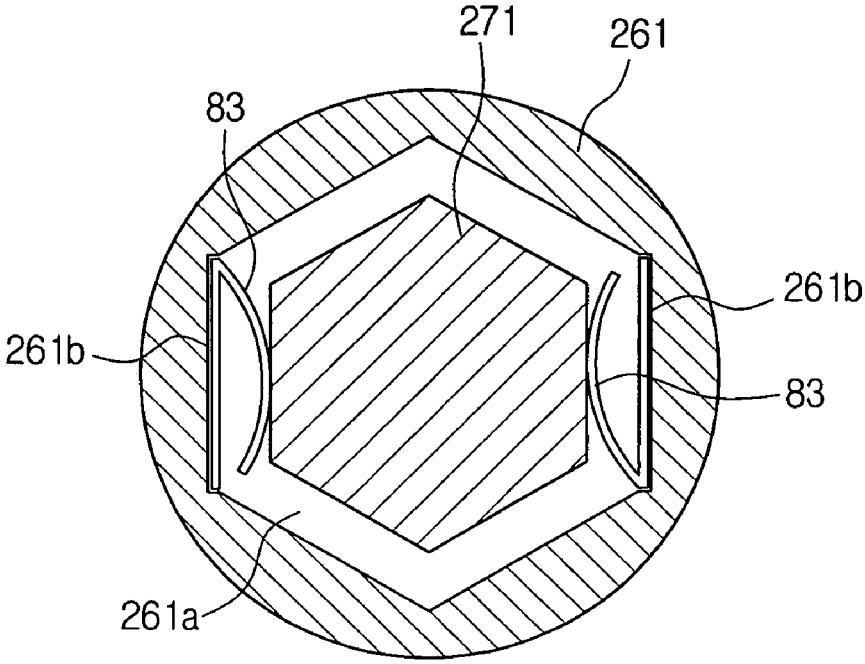
FIG. 8 is a sectional view for explaining a third embodiment of a power transmitting unit shown in FIG. 3A.
Figure 9:
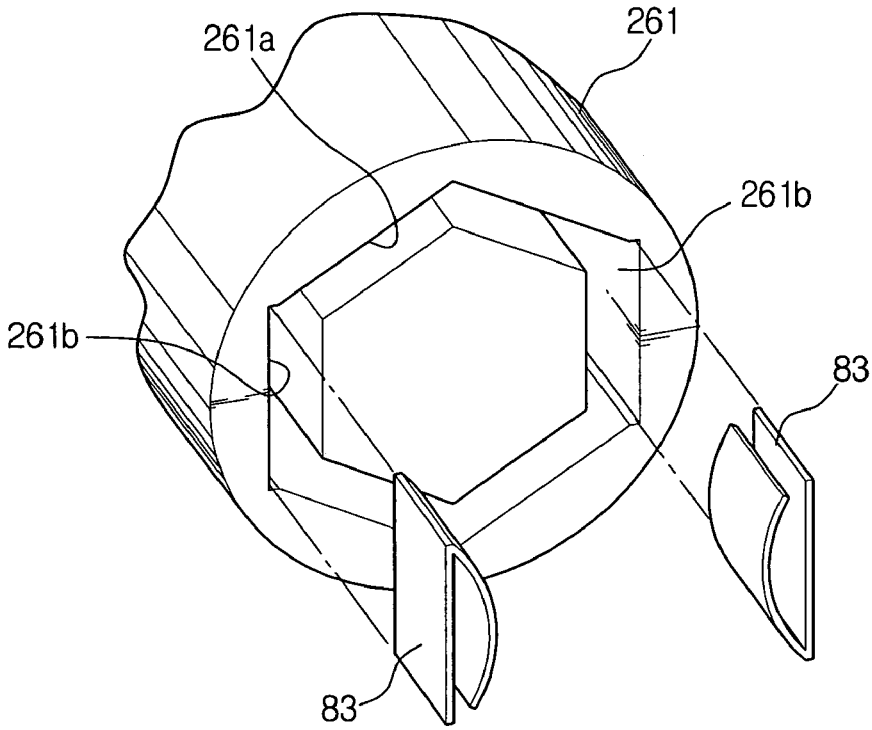
FIG. 9 is an exploded and perspective view of an exemplary spring of FIG. 8.

As a third embodiment for the power transmission unit 80, as shown in FIG. 8, a plate spring 83 disposed between a sub axis 271 and a main axis 261 can be applied. More than one plate spring 83 may be provided, but preferably, a plurality of plate springs 83 are symmetrically located with respect to the sub axis 271. The sub axis 271 has a non-circular section, and the axis recess 261*a* of the main axis 261 also has a non-circular section, such that the friction applied to the both axes 261 and 271 by the plate spring 83 is maintained at equal to or more than a certain degree. As shown in FIG. 9, the plate spring 83 has a clip shape to be received in a supporting recess 261*b* formed on an inner circumference of the axis recess 261*a* of the main axis 261, thereby contacting the sub axis 271 (not shown).

Figure 10:
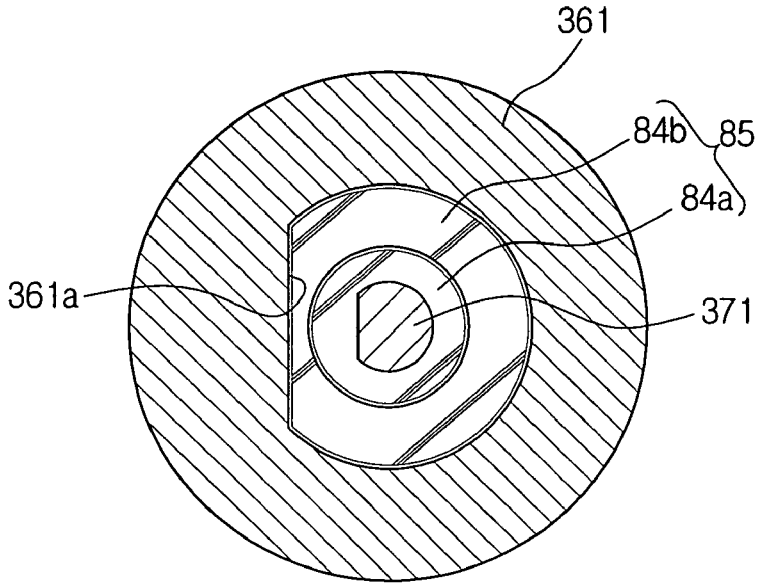
FIG. 10 is a sectional view for explaining a fourth embodiment of a power transmitting unit shown in FIG. 3A.

As shown in FIG. 10, a torque limiter 85 may be applied for a fourth embodiment of the power transmission unit 89. The torque limiter 85 is disposed between a sub axis 371 and a main axis 361. A driving part 84*a* of the torque limiter 85 is connected to operate with the main axis 361, and a slavery driving part 84*b* is connected to operate with the sub axis 371. Therefore, the sub axis 371 has a non-circular section, and the axis recess 361*a* of the main axis 361 also has a non-circular section. The torque limiter 85, which is widely used in industrial fields, selectively transmits torque according to a load applied to the slavery driving part 84*b*. A detailed description about the torque limiter will be omitted since it is well known.

Also, the agitator according to embodiments of the present invention is for agitating the developer 1, which is a mixture of the toner 2, and the carrier 3. However, the agitator sure can be widely used to agitate other compounds in which at least two materials having different specific gravities are mixed.

According to an embodiment of the present invention, by adopting a plurality of agitators, in place of a single agitator, each having applied a different rotational load, a compound of at least two materials, which has precipitated and clotted due to a long time of nonuse, such as a liquid developer, can be easily agitated with minimal driving force. Therefore, the normal driving of the agitators is possible without adding a driving motor.

In addition, since the plurality of the agitators can be selectively operated by the single driving source without any other dedicated power source, the great load of the toner sludge does not block the operation of the agitators.

Furthermore, if the agitator as described above is employed in an image forming apparatus, since the liquid developer is still usable even after a long time of nonuse, reliability of the product is improved.

While the invention has been shown and described with reference to certain embodiments thereof, it will be understood by those skilled in the art that various changes in form and details may be made therein without departing from the spirit and scope of the invention as defined by the appended claims.

What is claimed is:

1. An agitator comprising:

a container for storing a compound of at least two materials; and an agitation unit mounted in the container to agitate the compound and comprising a plurality of agitators of which at least one agitator can independently rotate;

wherein the agitation unit comprises:

a first agitator rotatably mounted in the container to be driven by a driving source; and a second agitator, connected to the first agitator, is passively driven by the first agitator;

wherein the agitation unit further comprises a power transmission unit to selectively transmit a driving force of the first agitator to the second agitator such that the second agitator is passively driven.

2. The agitator of claim 1, wherein the first agitator has a larger rotational radius than the second agitator.

3. The agitator of claim 1, wherein the first agitator comprises:

a main axis rotatably supported by the container to be rotated by the driving source; and an agitation member rotated in connection with the main axis to agitate the compound in the container.

4. The agitator of claim 3, wherein the agitation member is a spring spirally extended with respect to the rotation center thereof.

5. The agitator of claim 3, wherein the main axis comprises at least two axes, wherein each main axis is rotatably mounted on opposite sidewalls in the container.

6. The agitator of claim 3, wherein the second agitator comprises:

a sub axis supported by the main axis to be selectively and passively rotated by the main axis; and a rib spirally formed on an outer circumference of the sub axis.

7. The agitator of claim 6, wherein the agitation unit further comprises a power transmission unit mounted between the main axis and the sub axis to selectively transmit the driving force of the main axis to the sub axis.

8. The agitator of claim 6, wherein the rib has a smaller rotational radius than the agitation member and does not contact the agitation member.

9. The agitator of claim 1, wherein the power transmission unit is mounted to at least one of the first and the second agitators and comprises a friction member for supplying friction between the first and the second agitators.

10. The agitator of claim 9, wherein the friction member is made of rubber.

11. The agitator of claim 9, wherein the friction member is a metal spring.

12. The agitator of claim 1, wherein the power transmission unit comprises a torque limiter between the first and the second agitators.

13. The agitator of claim 1, wherein the driving force transmitted from the first agitator to the second agitator by the power transmission unit is inversely proportional to a rotational load applied by the compound, which is applied to the second agitator.

14. The agitator of claim 1, wherein the plurality of agitators have different rotational loads.

15. The agitator of claim 1, wherein the first agitator has a smaller contact area with the compound than the second agitator.

16. The agitator of claim 1, wherein the compound includes a developer where a powdery toner and a liquid carrier are mixed at certain mixture ratio.

17. The agitator of claim 16, wherein the agitation unit comprises:

a first agitator for agitating the toner precipitated in the container; and a second agitator for agitating the carrier and toner, which is primarily agitated by the first agitator.

18. The agitator of claim 1, wherein the compound comprises a solid and a liquid having different specific gravities from each other.

19. The agitator of claim 18, wherein the agitation unit comprises:

a first agitator for bringing to the surface the solid precipitated in the liquid; and a second agitator for mixing the solid brought to the surface by the first agitator with the liquid.

20. An image forming apparatus comprising:

a container for storing a developer which will be supplied to a developing unit;

an agitation unit mounted in the container to agitate the developer stored in the container, wherein the agitation unit comprises a plurality of agitators of which at least one agitator can independently rotate; and a driving source for supplying a driving force to rotate the agitation units;

wherein the agitation unit comprises:

a first agitator that is directly rotated by the driving force from the driving source; and a second agitator, which is passively driven through a connection with the first agitator;

wherein the agitation unit further comprises a power transmission unit for selectively transmitting the driving force of the first agitator to the second agitator.

21. The image forming apparatus of claim 20, wherein a second agitator is rotated when a predetermined rotational load is applied.

* * * * *